US007311235B2

(12) United States Patent
Aoki

(10) Patent No.: US 7,311,235 B2
(45) Date of Patent: Dec. 25, 2007

(54) ELECTRIC STAPLER WITH PENCIL SHARPENER

(75) Inventor: Tomoaki Aoki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/420,584

(22) Filed: May 26, 2006

(65) Prior Publication Data

US 2006/0266786 A1 Nov. 30, 2006

(30) Foreign Application Priority Data

May 27, 2005 (JP) ..... 2005-155200

(51) Int. Cl.
*B25C 5/15* (2006.01)

(52) U.S. Cl. ..... 227/7; 227/76; 227/131; D8/50; D19/73; 7/160

(58) Field of Classification Search ..... 227/5, 227/7, 131, 76; 7/160; D8/49, 50; D19/72, D19/73

See application file for complete search history.

(56) References Cited

U.S. PATENT DOCUMENTS 3,678,975 A * 7/1972 Imanishi et al. ..... 144/28.5
4,727,610 A * 3/1988 Lin ..... 7/160
4,779,785 A * 10/1988 Amagaya ..... 227/76
D383,783 S * 9/1997 Jeter et al. ..... D19/65
5,979,734 A * 11/1999 Chang ..... 227/76
D445,323 S * 7/2001 Arns ..... D8/50
D503,321 S * 3/2005 Harris ..... D8/50
6,948,409 B2 * 9/2005 Ackeret et al. ..... 81/440
D512,461 S * 12/2005 Tsuruha ..... D19/73
7,143,922 B2 * 12/2006 Shevin-Sandy ..... 227/156
2002/0190952 A1 * 12/2002 Shah ..... 345/163
2005/0242151 A1 * 11/2005 Bargo et al. ..... 227/7

FOREIGN PATENT DOCUMENTS

JP 6-227199 8/1994
JP 2000-153469 6/2000

OTHER PUBLICATIONS

English Language Abstract of JP 2000-153469.
English Language Abstract of JP 6-227199.

* cited by examiner

*Primary Examiner*—Scott A. Smith
(74) *Attorney, Agent, or Firm*—Greenblum & Bernstein, P.L.C.

(57) ABSTRACT

An electric pencil sharpener is accommodated in a front part of a lower housing. An electric stapler is accommodated in an upper housing including a shared surface that is used as a top face of the lower housing, as its bottom face. A power transformer for supplying DC power to the electric stapler is arranged in a rear part of the lower housing. The shared surface also serves as a paper table used for guiding a bundle of paper into the electric stapler. A caulking plate for bending both legs of a staple that is made to penetrate through the bundle of paper by a hammer is provided on the shared surface. Since the electric stapler is arranged in an upper part and the electric pencil sharpener is arranged in a lower part, it is possible to provide an electric stapler with pencil sharpener in which cutting waste generated by sharpening a pencil does not affect the stapling operation and good stability is achieved because of a lowered weight balance and which requires only a small installation area on a desk.

4 Claims, 4 Drawing Sheets

ELECTRIC STAPLER WITH PENCIL SHARPENER

The present disclosure relates to subject matter contained in priority Japanese Patent Application No. 2005-155200, filed on May 27, 2005, the contents of which is herein expressly incorporated by reference in its entirety.

BACKGROUND OF THE INVENTION

1. Field of the Invention

The present invention relates to an electric stapler with pencil sharpener in which an electric stapler and an electric pencil sharpener are integrated with each other as one unit.

2. Description of the Related Art

An electric stapler can automatically staple a plurality of sheets of paper together only by inserting the plurality of sheets of paper into a predetermined stapling position, thereby improving efficiency of office work that handles volumes of documentation or the like. As such an electric stapler, a conventional technique shown in FIG. 4 is known (see Japanese Patent Publication No. 2000-153469, for example).

This type of electric stapler can be operated as follows: AC power is stepped down to a predetermined voltage by a power transformer 105 and is then rectified and smoothed so as to obtain DC power. The DC power is supplied to a DC motor 108. The DC motor 108 drives a driving mechanism 107, thereby driving a crank rod 106 to pivotally move. The crank rod 106 moves down a hammer 103 to push out one staple from a staple array accommodated in a holder 109. Then, the staple penetrates through a bundle of paper put on a paper table 101, and a pair of legs of the staple are bent inward by means of a caulking plate 102 provided under the paper table 101. In this manner, the bundle of paper is stapled together. In this electric stapler, when a bundle of paper is put on the paper table 101, a switch lever (not shown) starts to operate to activate the DC motor 108. After a stapling operation, the DC motor 108 automatically stops. Therefore, efficiency of work for stapling the bundle of paper can be largely improved.

An electric pencil sharpener is used as a convenient tool in a site where a pencil is frequently used and various types of pencils are used, such as a site of design work, although the use of pencils is reduced because of diversification of writing tools such as a mechanical pencil. There are known various forms of electric pencil sharpeners (see Japanese Patent Publication No. 6-227199, for example).

FIG. 5 shows an exemplary electric pencil sharpener. When a pencil is inserted into an insertion port 110, a cutter 111 is driven to rotate by an AC motor 115. Thus, the cutter 111 sharpens an inserted end of the pencil into a conically shaped tip. Cutting waste generated by the cutter 111 is stored in a waste basket 112. In this manner, it is possible to quickly and cleanly sharpen the pencil only by inserting it into the electric pencil sharpener. Thus, efficiency of work frequently using pencils can be improved.

However, if it is demanded that both of the electric stapler and the electric pencil sharpener can be used, when those two devices are put on a desk, a useful area on the desk is unnecessarily reduced. Moreover, a component that can be shared by those two devices, such as a driving power source, are required doubly.

BRIEF SUMMARY OF THE INVENTION

Therefore, it is an object of the present invention to provide an electric stapler with pencil sharpener that is formed by an electric stapler and an electric pencil sharpener integrated with each other so as to allow them to be conveniently installed and used.

An electric stapler with pencil sharpener according to the present invention includes; an electric pencil sharpener, that is activated by insertion of a pencil into an insertion port to sharpen the pencil, being provided in a lower part; and an electric stapler, that is activated by insertion of a bundle of paper onto a stapling position to staple the bundle of paper, being provided above the electric pencil sharpener.

According to the electric stapler with pencil sharpener having the above structure, functions of the electric pencil sharpener and the electric stapler are integrated with each other. However, those are arranged one above the other. Therefore, a small installation area is sufficient for the purpose. That is, those two functions are arranged on a desk without increasing an occupied area on the desk. Moreover, cutting waste generated by the pencil sharpener does not affect the function of the stapler because the function of the pencil sharpener is arranged in the lower part.

In addition, a power transformer for generating DC power that serves as an electric driving source of the electric stapler is provided in the lower part in which the electric pencil sharpener is provided in the above structure. That is, the heavy power transformer is located in the lower part. Thus, a weight balance in the entire device is lowered and therefore stability is improved. Moreover, a volume of the electric stapler arranged in an upper part is reduced. Due to those, the entire size is reduced and the stability is more improved.

A shared AC-DC conversion circuit for supplying driving power to the electric pencil sharpener and the electric stapler may be provided. In this case, a power supply circuit is shared between the electric pencil sharpener and the electric stapler. Therefore, the number of components in the entire device is reduced, thus reducing the size and cost.

Moreover, a top face of a lower housing for accommodating the electric pencil sharpener may be formed as a shared surface that also serves as a bottom face of an upper housing for accommodating the electric stapler, and the shared surface may further serve as a paper table on which the bundle of paper inserted into the electric stapler is stapled. In this case, an outer package is simplified and the paper table that is an essential component of the electric stapler is formed in a simple manner.

While novel features of the invention are set forth in the preceding, the invention, both as to organization and content, can be further understood and appreciated, along with other objects and features thereof, from the following detailed description and examples when taken in conjunction with the attached drawings.

DESCRIPTION OF THE PREFERRED EMBODIMENTS

Figure 1:
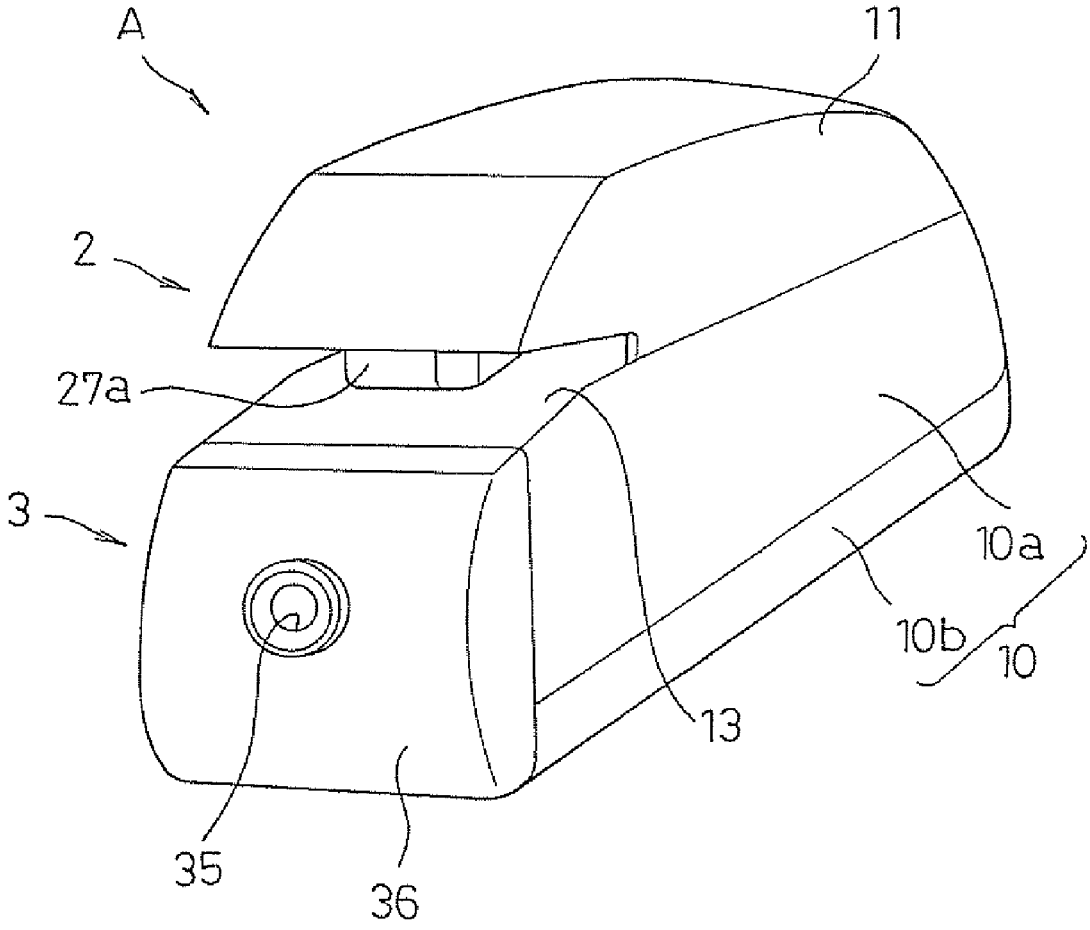
FIG. 1 is a perspective view showing the appearance of an electric stapler with pencil sharpener according to a first embodiment of the present invention.
Figure 2:
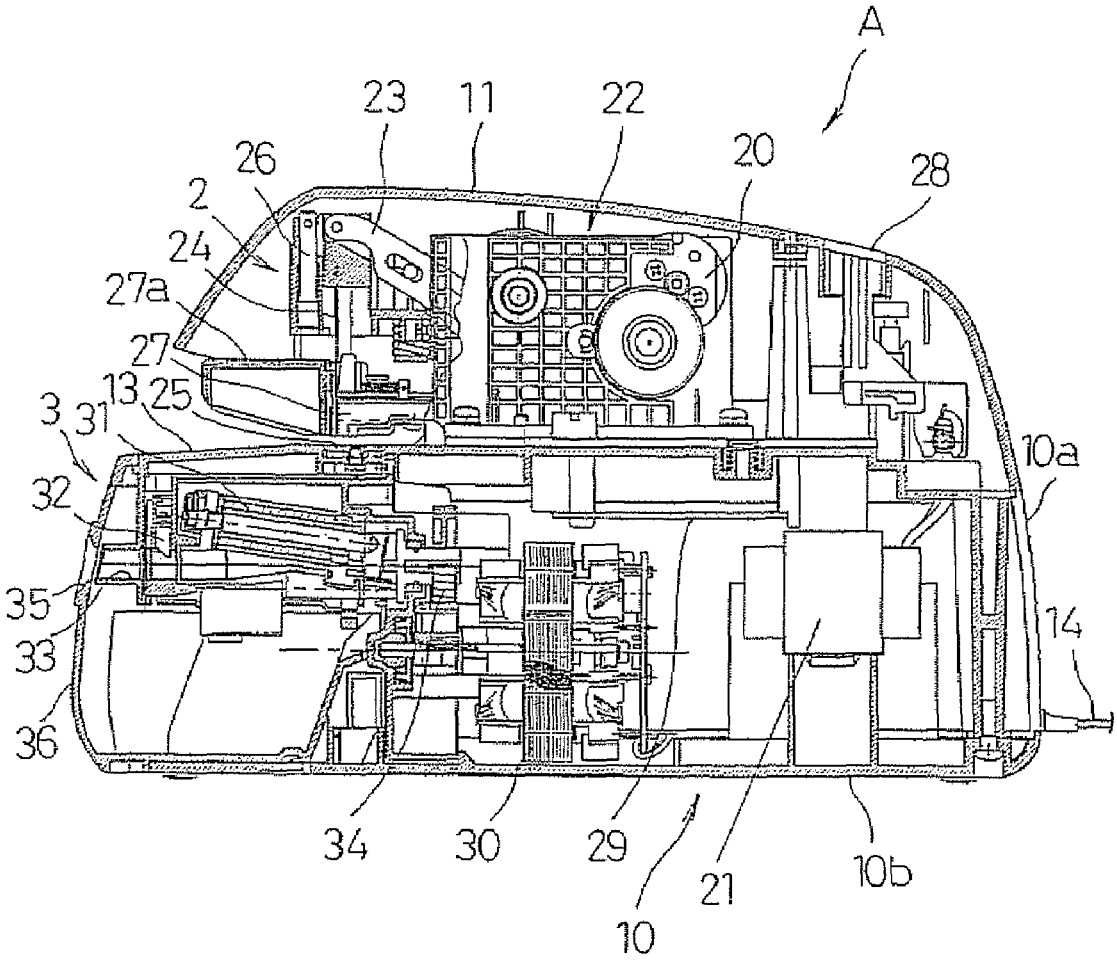
FIG. 2 is a cross-sectional view showing the structure of the electric stapler with pencil sharpener according to the first embodiment of the present invention.
Figure 3:
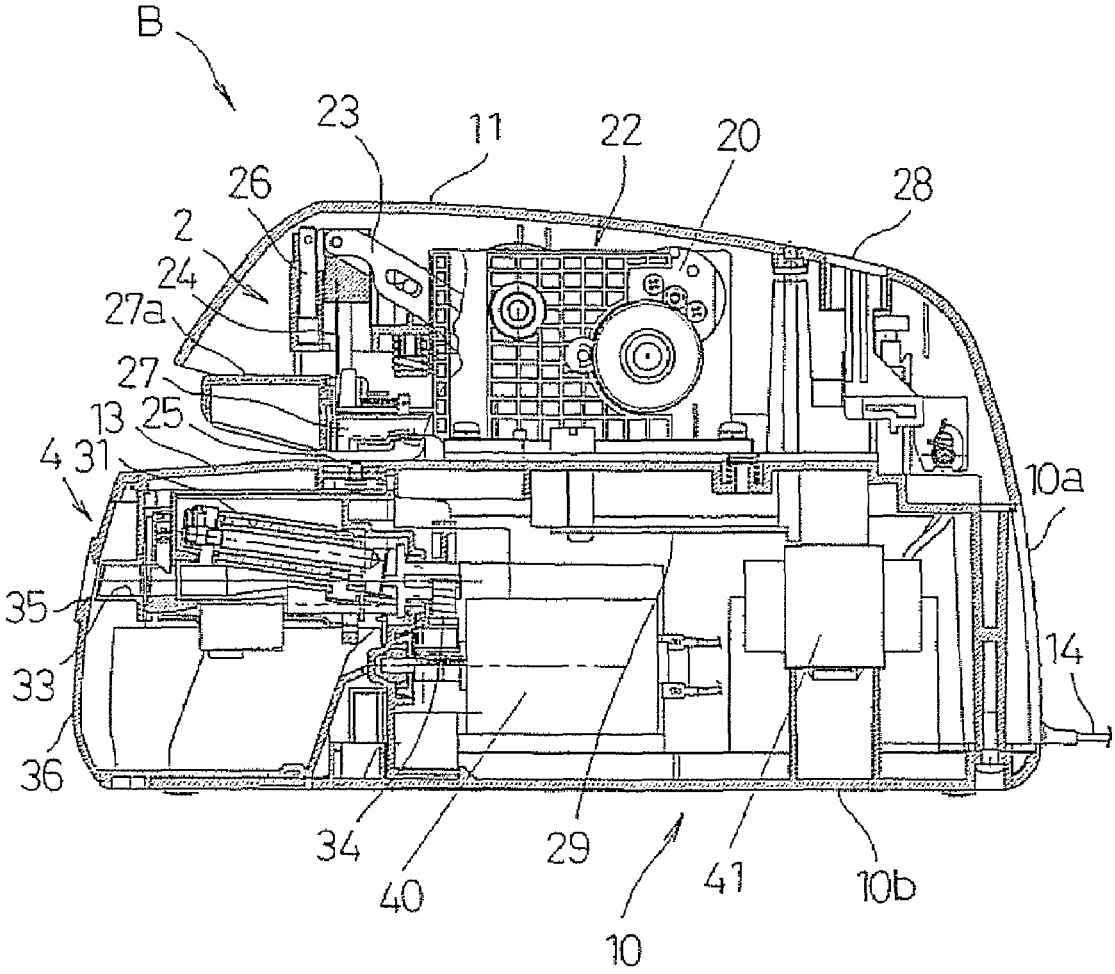
FIG. 3 is a cross-sectional view showing the structure of an electric stapler with pencil sharpener according to a second embodiment of the present invention.
Figure 4:
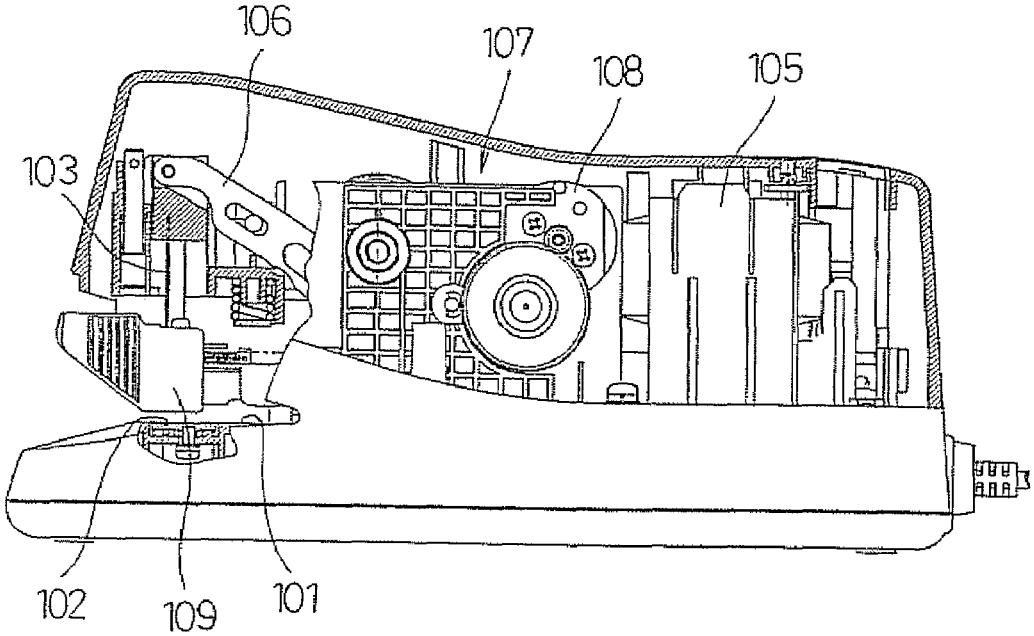
Fig. 4 Prior Art
FIG. 4 is a cross-sectional view showing the structure of a conventional electric stapler.
Figure 5:
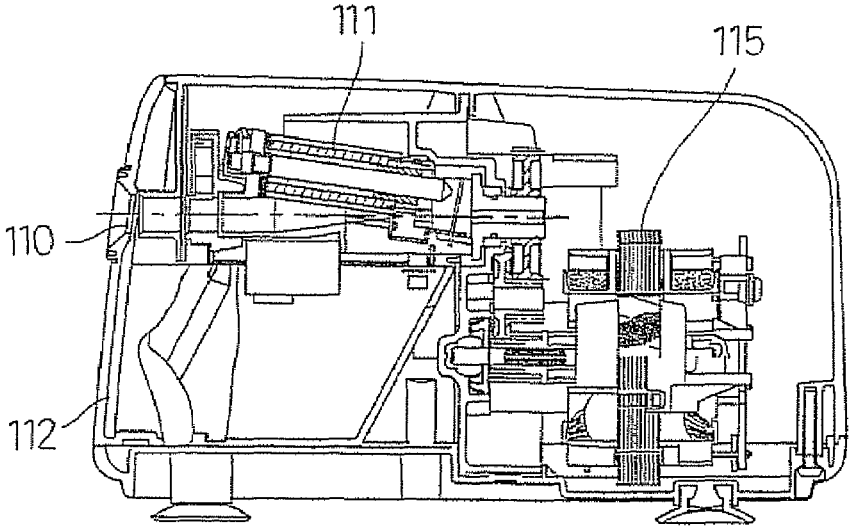
Fig. 5 Prior Art
FIG. 5 is a cross-sectional view showing the structure of a conventional electric pencil sharpener.

With reference to FIGS. 1 to 3, the present invention will now be described in accordance with the embodiments. Note that the embodiments do not intend to limit the scope of the present invention, but exemplify the invention.

FIG. 1 shows the appearance of an electric stapler with pencil sharpener A according to a first embodiment of the present invention. The electric stapler with pencil sharpener A is configured to include: a lower housing 10 consisting of a lower case 10*b* and a middle case 10*a* arranged on the lower case 10*b*; an upper housing 11 arranged on the lower housing 10; an electric stapler 2 accommodated in the upper housing 11; and an electric pencil sharpener 3 accommodated in the lower housing 10. A top face of the middle case 10*a* of the lower housing 10 and a bottom face of the upper housing 11 are formed as a surface 13 shared by the lower housing 10 and the upper housing 11. The shared surface 13 serves as a paper table on which a bundle of paper to be stapled by the electric stapler 2 is put.

FIG. 2 is a cross-sectional view of the electric stapler with pencil sharpener A having the above structure. The electric pencil sharpener 3 is arranged in a front part of the lower housing 10, which is formed by the lower case 10*b* and the middle case 10*a* that are separately molded from resin. The electric stapler 2 is arranged in the upper housing 11 including the shared surface 13 that serves as the top face of the lower housing 10, as its bottom face. The electric pencil sharpener 3 and the electric stapler 2 are configured to operate using AC power as a power source.

The electric stapler 2 is configured to have approximately the same structure as that described in accordance with the conventional technique. However, a power transformer 21 is arranged in the lower housing 10 behind the electric pencil sharpener 3. In this configuration, the power transformer 21 forms a power supply circuit for generating, from AC power, DC power to be supplied to a DC motor 20 as an electric driving power source and a control circuit. This arrangement of the power transformer 21 can make the electric stapler 2 arranged in an upper part smaller. Moreover, stability of the entire device can be improved because the heavy power transformer 21 is located in a lower part.

The electric pencil sharpener 3 is also configured to have approximately the same structure as that described in accordance with the conventional technique. That is, an AC motor 30 drives a cutter 31 to rotate, thereby sharpening a pencil inserted into an insertion port 35. Cutting waste is stored in a waste basket 36.

AC power supplied through a power cord 14 is stepped down to a predetermined voltage by the power transformer 21 and is then rectified and smoothed to obtain DC power having a predetermined voltage. The electric stapler 2 operates by the DC power. A front side of the upper housing 11 accommodating the electric stapler 2 is opened, and an edge of the front side is away from the shared surface 13 by a predetermined distance, as shown in FIG. 2. This forms an insertion port into which a bundle of paper to be stapled is inserted. The shared surface 13 that is the bottom face of the upper housing 11 also serves as a paper table on which the bundle of paper to be stapled by the electric stapler 2 is put. The shared surface 13 is formed to be in a gentle decline forward so as to allow easy insertion of the bundle of paper. In addition, a caulking plate 25 for bending both legs of a staple that is made to penetrate through the bundle of paper by a hammer 24 is fixed on the shared surface 13.

When a bundle of paper is slid on the shared surface 13 and inserted to locate a site to be stapled on the caulking plate 25, a switch lever (not shown) is activated by the bundle of paper and the control circuit closes a power distribution circuit to the DC motor 20. Thus, the DC motor 20 starts to operate. Rotation of the DC motor 20 drives a driving mechanism 22 including a gear assembly, a crank mechanism, and the like, which in turn drives a crank rod 23 to pivotally move. The pivotal downward movement of a top end of the crank rod 23 from its top dead center shown in FIG. 2 causes a paper holding rod 26 and the hammer 24 to start to move down. The paper holding rod 26 applies a pressure to a staple holder 27 that is supported by an axis in its rear part to be pivotally movable, so that the bundle of paper is pressed against the shared surface 13 by a lower surface of the staple holder 27. The hammer 24 pushes out one staple from a staple array accommodated in the staple holder 27 and makes both legs of that staple penetrate through the bundle of paper. A guide groove is formed in the caulking plate 25 and the legs of that staple are bent along the guide groove by applying the pressure of the hammer 24. In this manner, the bundle of paper is stapled together. Then, the crank rod 23 pushing down the hammer 24 pivotally moves upward from its bottom dead center because of rotation of the DC motor 20, thereby moving the hammer 24 and the paper holding rod 26 upward. A state in which the hammer 24 and the paper holding rod 26 have reached their top dead centers shown in FIG. 2 is detected by hammer position detection means (not shown), and power distribution to the DC motor 20 is then stopped. Thus, the hammer 24 and the paper holding rod 26 are stopped at the shown positions and get ready for a next stapling operation.

A staple case knob 27*a* of the staple holder 27 is located at the front opening of the upper housing 11. When an eject button 28 is pressed, a staple case for accommodating staples is removed from the staple holder 27. When the staple case is pulled out with the staple case knob 27*a* grasped, staples are replenished in the staple case. When the staple case knob 27*a* is pushed in, the staple case with the replenished staples is locked in the shown state.

In the electric pencil sharpener 3 provided in the lower housing 10, the waste basket 36 for storing cutting waste is removably arranged in a front part of the lower housing 10. An insertion port 35 into which a pencil is inserted is opened on a front side of the waste basket 36. When a pencil is inserted into the insertion port 35, the pencil gets into a cylindrical guide tube 33, and then pushes a switch lever 32 having a top end projecting into the guide tube 33 upward. Thus, the switch lever 32 that is biased by a spring moves back and closes a power-supply circuit of an AC motor 30. Therefore, the AC motor 30 starts to operate. Rotation of the AC motor 30 drives a cutter 31 to rotate via a gear assembly 34, so that the tip of the pencil is conically sharpened by the cutter 31 that is arranged to be inclined.

The cutting waste of sharpening the pencil by the cutter 31 falls into the waste basket 36 and is stored therein. The waste basket 36 is removable from the lower housing 10 by being drawn forth from the lower housing 10. Thus, disposal of the cutting waste is performed easily. While the waste basket 36 is removed, the power-supply circuit of the AC motor 30 is blocked by waste basket removal detection means (not shown). Thus, the cutter 31 cannot be driven to rotate while the waste basket 36 is drawn out. Therefore, the cutting waste never scatters because of sharpening of the pencil in a state in which no waste basket 36 is attached, and risk of rotation of a rotating component while the rotating component is exposed are avoided.

The electric stapler with pencil sharpener A having the above structure has a small installation area, although the electric stapler 2 and the electric pencil sharpener 3 are integrated with each other. This is because functions of both devices are arranged one above the other. Moreover, a volume of the electric stapler 2 is largely reduced, because the power transformer 21 and a circuit board 29 that are components of the electric stapler 2 are arranged in the lower housing 10. Moreover, a weight balance is lowered because the power transformer 21 and the AC motor 30 that are heavy are arranged in the lower housing 10. In addition, the volume of the electric stapler 2 provided in the upper part is reduced. Thus, stability is improved. Due to the above, while the two functions of the electric stapler 2 and the electric pencil sharpener 3 are arranged on a desk, an occupied area on the desk is equivalent to an area required for one device, and any of those functions can be used conveniently and stably.

Next, an electric stapler with pencil sharpener B according to a second embodiment of the present invention will be described with reference to FIG. 3. Components in this electric stapler with pencil sharpener B that are common with the electric stapler with pencil sharpener A of the first embodiment are labeled with the same reference numerals and the description thereof is omitted.

Referring to FIG. 3, the electric stapler with pencil sharpener B of the second embodiment is configured such that the cutter 31 of the electric pencil sharpener 4 provided in the lower housing 10 is driven to rotate by a DC motor 40. The electric stapler 2 provided in the upper housing 11 has the same structure as that in the first embodiment.

AC power supplied through the power cord 14 is stepped down to a predetermined voltage by a power transformer 41 provided in the lower housing 10 and is then rectified and smoothed by a power-supply circuit formed on the circuit board 29. In this manner, DC power having a predetermined voltage is generated. The thus generated DC power is used as driving power for the DC motor 40 serving as a driving source of the electric pencil sharpener 4, driving power of the DC motor 20 serving as the driving source of the electric stapler 2, and control power for operating the control circuit of the electric stapler 2. Therefore, the power transformer 41 and the rectification and smoothing circuit are configured to have power capacity exceeding power consumption by the two DC motors 20 and 40.

In the electric stapler with pencil sharpener B of the second embodiment, the driving source of the electric pencil sharpener 4 is formed by the DC motor 40 and therefore reduction of the weight and the size is achieved as compared with the case of using an AC motor. Thus, the entire weight is reduced. Moreover, the power-supply circuit for supplying DC power to the respective DC motors 20 and 40 is shared by the DC motors 20 and 40. Therefore, it is not necessary to form a power-supply circuit individually for each of the electric stapler 2 and the electric pencil sharpener 4, thus reducing the number of components.

In the aforementioned electric staplers with pencil sharpener A and B, the cutting waste generated by sharpening a pencil does not affect the function of the stapler, because the electric pencil sharpeners 3 and 4 are arranged in the lower part and the electric stapler 2 is arranged in the upper part. Moreover, the top face of the lower housing 10 accommodating the electric sharpener 3 or 4 is formed as the shared surface 13 that is also used as the bottom face of the upper housing 11 accommodating the electric stapler 2, and the shared surface 13 serves as the paper table on which a bundle of paper inserted into the electric stapler 2 is put. Therefore, an outer package that encompasses the two functions integrally is formed without waste. That is, the electric staplers with pencil sharpener A and B is made compact.

As described above, according to the present invention, functions of an electric pencil sharpener and an electric stapler are integrated with each other and they are arranged one above the other. Thus, an installation area is small and those two functions are arranged on a desk without increasing an occupied area on the desk. Moreover, cutting waste generated by the pencil sharpener does not affect the function of the stapler because the function of the pencil sharpener is arranged in a lower part. In addition, the two functions are integrated with each other and a component that is common to those two functions is shared. Therefore, the size and the cost of an entire device are reduced as compared with the case where the two functions are formed separately from each other.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. An electric stapler and pencil sharpener assembly comprising:

an electric pencil sharpener which is configured to be activated by insertion of a pencil into an insertion port to sharpen the pencil, the pencil sharpener being provided in a lower part of the assembly; and an electric stapler which is configured to be activated by insertion of a bundle of paper within a stapling position to staple the bundle of paper, the electric stapler being provided above the electric pencil sharpener in an upper part of the assembly.

2. The assembly of claim 1, further comprising a power transformer configured to generate DC power, the power transformer comprising an electric driving source of the electric stapler, and the power transformer being provided in the lower part of the assembly.

3. The assembly of claim 1, further comprising a shared AC-DC conversion circuit configured to supply driving power to the electric pencil sharpener and the electric stapler.

4. The assembly of claim 1, wherein a top face of a lower housing which accommodates the electric pencil sharpener comprises a shared surface, the shared surface providing a bottom face of an upper housing which accommodates the electric stapler, and the shared surface providing a paper table configured to receive the bundle of paper inserted into the electric stapler.

* * * * *